US010385504B2

(12) United States Patent
Riehl et al.

(10) Patent No.: US 10,385,504 B2
(45) Date of Patent: Aug. 20, 2019

(54) METHOD FOR THE CHLORINE-FREE ANTI-FELTING TREATMENT OF WOOL

(71) Applicant: SCHOELLER GMBH & COKG, Bregenz (AT)

(72) Inventors: Michael Riehl, Hard (AT); Jim Valakuzhy, Hard (AT); Peter Loacker, Hard (AT); Markus Krüger, Hard (AT); Kurt Haselwander, Hard (AT); Ján Široký, Hard (AT); Amalid Mahmud-Ali, Dornbirn (AT); Margit Lenninger, Dornbirn (AT); Thomas Bechtold, Dornbirn (AT)

(73) Assignee: SCHOELLER GMBH & CO KG, Bregenz (AT)

( * ) Notice: Subject to any disclaimer, the term of this patent is extended or adjusted under 35 U.S.C. 154(b) by 0 days.

(21) Appl. No.: 15/021,886

(22) PCT Filed: Sep. 11, 2014

(86) PCT No.: PCT/AT2014/050201
§ 371 (c)(1),
(2) Date: Mar. 14, 2016

(87) PCT Pub. No.: WO2015/035439
PCT Pub. Date: Mar. 19, 2015

(65) Prior Publication Data

US 2016/0222578 A1 Aug. 4, 2016

(30) Foreign Application Priority Data

Sep. 12, 2013 (AT) ..... A 50579/2013

(51) Int. Cl.

| | |
|---|---|
| ***D06M 11/55*** | (2006.01) |
| ***D06M 10/06*** | (2006.01) |
| ***D06M 11/32*** | (2006.01) |
| ***D06M 11/50*** | (2006.01) |
| ***D01C 3/00*** | (2006.01) |
| ***D06M 15/643*** | (2006.01) |
| *D06M 101/12* | (2006.01) |

(52) U.S. Cl.
CPC ..... *D06M 11/55* (2013.01); *D01C 3/00* (2013.01); *D06M 10/06* (2013.01); *D06M 11/32* (2013.01); *D06M 11/50* (2013.01); *D06M 15/643* (2013.01); *D06M 2101/12* (2013.01); *D06M 2200/45* (2013.01); *D06M 2400/01* (2013.01)

(58) Field of Classification Search
CPC ..... D06M 11/32; D06M 11/50; D06M 11/55; D06M 15/643; D06M 10/06; D06M 2200/45; D06M 2101/12; D06M 2400/01; D01C 3/00
See application file for complete search history.

(56) References Cited

U.S. PATENT DOCUMENTS 2,739,034 A * 3/1956 Fell ..... D06M 11/50
252/186.43

FOREIGN PATENT DOCUMENTS

| | | | | |
|---|---|---|---|---|
| CN | 1239525 CN | | 12/1999 | |
| EP | 0356950 | A2 | 3/1990 | |
| GB | 2174424 | * | 4/1986 | ..... D06M 3/00 |
| WO | WO9200412 | A1 | 1/1992 | |
| WO | WO93/13260 | * | 7/1993 | |
| WO | WO9313260 | A1 | 7/1993 | |
| WO | WO9910588 | A1 | 3/1999 | |

OTHER PUBLICATIONS

Notification of the Transmittal of Translation of the International Preliminary Report on Patentability for PCT Application No. PCT/AT2014/05201 dated Mar. 24, 2016.
International Preliminary Report on Patentability for PCT Application No. PCT/AT2014/05201 dated Mar. 24, 2016.
Austrian Search Report for Austrian App. No. A50579/2013 dated Jul. 24, 2014.
International Search Report for PCT Application No. PCT/AT2014/05201 dated Nov. 24, 2014 (German).
International Search Report for PCT Application No. PCT/AT2014/05201 dated Nov. 24, 2014 (English).
International Written Opinion on Patentability dated Nov. 24, 2014 (German).

* cited by examiner

*Primary Examiner* — Amina S Khan
(74) *Attorney, Agent, or Firm* — Workman Nydegger

(57) ABSTRACT

The method for the chlorine-free anti-felting treatment of wool comprises the steps of:

f) applying a solution onto the wool, wherein the solution has an oxidizing agent based on peroxomono sulphuric acid and a tenside,
g) exposing the wool to the solution in order to complete the oxidation process,
h) washing out the secondary reaction products from the wool,
i) treating the wool using a reduction agent and
j) post-washing, wherein the steps are carried out continuously.

16 Claims, No Drawings

METHOD FOR THE CHLORINE-FREE ANTI-FELTING TREATMENT OF WOOL

A method for the chlorine-free anti-felting treatment of wool The invention relates to a method for the chlorine-free anti-felting treatment of wool.

Wool is a protein fibre having a complex configuration. Conditioned by growth and the function or task, respectively, of the hair, the fibre core (cortex) is covered by a relatively hydrophobic layer. This external layer is called cuticula, being composed of overlapping cells arranged like shingles. Due to this external cell structure, a woolen hair has a different mechanical frictional resistance depending on the fibre direction or direction of the cell structure, respectively. The saw tooth-like structure enables slight shifting in one direction, whereas the fibres tend to getting caught in the other direction. This effect, in particular on the influence of wetness, temperature and mechanics, will lead to a compression of the textile wool structure, which is called felting. This process may be utilized in the selective compression of fleeces, fabrics and crocheted fabrics into felts/broadcloth/loden fabrics.

In many uses of fabrics and crocheted fabrics, however, the process of felting is undesired, as this will entail modified dimensions of a textile fabric and will further disadvantageously change the external appearance and the haptics of the product. Especially when washing, the influence of wetness, tensides, temperature and mechanics will lead to a strong mechanical compression of the woolen articles. For this reason, there are described appropriate measures and pre-treatments for wool in literature, which aim to prevent an undesired felting of woolen products when washing and in use.

Products, which have been subjected to especially high-quality treatments, are designated as machine washable, as there will be only particularly little shrinkage and felting. In order to pre-treat such a wool product so that it will become machine washable, there have been provided various methods in literature.

The most important process, this is the so-called "chlorine Hercosett process", uses a multi-stage treatment of the wool fibres using chlorine, followed by a reductive treatment using sulphite and a coating with polymeric substances. As an effect of these treatments, there is discussed a "masking" of the cell-like structure by oxidative reduction as a consequence of the chlorine treatment, by reductive removal of products by the treatment with sulphite (sulphitolysis) and by the coating with polymeric films. The products thus treated have excellent shrinkage values even following multiple machine washing steps. The operational technique, however, has rather significant disadvantages, which will arise from the use of chlorine as a treatment agent. Apart from the complicated application technique, with the method being carried out at room temperature, due to the effect of the chlorine, there will be developed critical waste water ingredients (AOX, adsorbable organic halogen compounds), which may be reduced by optimization but cannot be prevented and which are discharged in any case at high concentrations from the process.

Apart from the use of free chlorine, there have also be described methods using hypochlorite or other chlorine separating compounds such as, e.g., Na-dichlorine-isocyanurate (NaDCC). All these methods, however, have the common disadvantage of the formation and release of the AOX products.

In order to solve this problem, the use of chlorine-free oxidizing agents for the substitution of the chlorine compounds has been comprehensively studied. The use of mixtures of permanganate and hypochlorite has been described. Also the sole use of potassium permanganate, peracetic acid, organic peroxides and inorganic peroxides, ozones as an oxidizing agent has been described. Similarly, the use of plasma treatments or the use of proteolytic enzymes has been researched and described. All these methods have the same procedural disadvantages, which, as a consequence, will lead to an unsatisfying result for the features of the wool treated. From these methods, hence, no suitable method has been elaborated, which would enable the treatment of wool so that machine washability may be achieved.

In the case of a too intensive treatment, felting may be minimized; the stability of the wool, however, will then be reduced insofar as the wool is significantly damaged and cannot be processed anymore. From the methods mentioned above, there is currently not made available a useful alternative to chlorine treatment methods.

An important group of the technically easy-to-handle oxidizing agents on the basis of peroxide are peroxosulphates. These products are safely to handle materials having a high potential for oxidation, which seem to be suitable for an oxidative treatment of wool. Accordingly, this class of substances has been examined more intensively in view of the treatment of wool. The known methods, however, are not suitable for the manufacture of machine washable wool.

As technically feasible methods for the treatment of wool using inorganic peroxo compounds have not been known so far, it is the subject of the present invention to propose a method for the continuous treatment, which is suitable, also in the treatment of wool in technically relevant quantities, to achieve a high quality for the product.

According to prior art, there are provided various methods for the treatment of wool using peroxomonosulphate.

In a conventional embodiment, these methods are composed of an oxidative treatment using a solution containing peroxomonosulphate, followed by a reductive treatment. There is frequently further described a post-treatment using polymer. The methods are different in the type of the combination of the various methods and, accordingly, also in the results resulting from the treatment.

WO 92/00412 A1 describes a method for the continuous oxidative anti-felting treatment, in which a mixture of hydrochloric peroxide and potassium peroxomonosulphate are used for the treatment of wool by a mangle application. After a short reaction period of 1 min, the wool is immediately, without any intermediate rinsing, treated in a sulphite solution and provided with a polymer coating following further rinsing processes. There will, however, be observed very high shrinkage due to washing.

WO 93/13260 A shows a discontinuous treatment method for wool, as the sample pieces are always placed into treatment solutions. Apart from the impregnation step in the application example 3, there is provided a step-like treatment for the remaining steps.

EP 0 356 950 describes a discontinuous method for the treatment of crocheted woolen fabrics.

WO 99/10588 A1 discloses a method for the treatment of wool using peroxomonosulphate solutions, in which as a first step a pre-cross-linking using a tenside solution is realized, followed by the oxidation treatment, the reductive treatment and the coating with a polymer. The procedure disclosed in this publication is completely continuous, thus offering no possibility to alter the short reaction period, being shorter than 1 min, after the treatment using an oxidizing agent. Combination of the wetting agent treatment and the treatment with an oxidizing agent is not recommended, as this will lead to poor product quality (application example 1, tests 3, 4 and 5). The process has not been accepted in technical reality, as procedural stability and reproducibility have to be assessed critically. Due to the short reaction period, the use of pre-wetted products for the treatment with oxidizing agents and the omitting of intermediate rinsing between the treatment compartments, required for reasons of machine dimensions, a control of the treatment conditions and, hence, the result is critical.

According to prior art, there have been proposed and tested the most varied methods, which are to enable a chlorine-free treatment of wool for the production of machine washable products. An improvement of the wool characteristics in regard to non-treated wool, however, has not been achieved; the methods, however, are more complicated, require in many cases the use of additional chemicals, and are rather difficult to control in regard to the quality standards achieved. Accordingly, it has not been possible to make technical use of the methods for the production of products having the same quality level as those following the classical chlorine Hercosett treatment.

It is, hence, the task of the present invention to provide a method, which is able to produce machine washable wool in a chlorine-free process so that the disadvantages mentioned above are prevented.

This task is solved by a method for the chlorine-free anti-felting treatment of wool, characterized by the steps of a) applying a solution onto the wool, wherein the solution has an oxidizing agent based on peroxomono sulphuric acid and a tenside,
b) exposing the wool to the solution in order to complete the oxidation process,
c) washing out the secondary reaction products from the wool,
d) treating the wool using a reduction agent and
e) post-washing, wherein the steps are carried out continuously.

The solution is preferably an aqueous solution.

There is preferably provided that the oxidizing agent comprises an inorganic monoperoxo compound, in particular peroxomono sulphuric acid ($H_2SO_5$), the salts thereof or combinations thereon. As salts of the peroxomono sulphuric acid, there may be considered, for example, $KHSO_5$, ($2KHSO_5.KHSO_4.K2SO_4$).

In an embodiment variant there has been shown that the amount of peroxomono sulphuric acid may be, based on the mass of wool, between 0.5 and 25% by weight, preferably between 1% by weight and 20% by weight, especially preferably not more than 15% by weight. The concentrations in the prepared formulation may be calculated according to the adjustments of the order unit and the inorganic peroxomonosulphate compound used.

The chemicals required for the procedural step of a) are applied in a dissolved form, wherein in a preferred embodiment there are used aqueous solutions. It has proven to be advantageous if the solution applied has a pH of <7. The pH preferably is between 1 and 4, especially preferably the pH in the solution is less than 3.5. By dissolving the peroxomono sulphuric acid compounds, the pH of the solution will decrease. By appropriate additions in the form of an acid or base, respectively, the pH may be adjusted according to requirements.

It has proven to be advantageous for the method if the temperature of the solution in step a) is up to 60° C., preferably between 15° C. and 45° C.

In an embodiment variant, the reaction period of step b) may be more than 1.5 min, preferably between 5 and 10 min.

The wool to be treated is to be processable using a continuously operating machine, e.g., yarn, fleece, sliver, fabrics, crocheted fabrics, sliver or combinations thereof. In a preferred embodiment, slivers are treated. If there are used the appropriate guiding devices, there is further possible a treatment in an open form (loose fibres).

The wool may be present as pure wool or as a wool blend.

The tenside preferably has a negative overall charge or a neutral charge of the surface active molecule part. Especially preferably, the tenside is selected from the group of non-ionic tensides.

The wetting agent required for step a) may originate from the group of anionic or non-ionic tensides, with non-ionic products being preferred, especially preferred being alkylene oxide condensation products.

In an embodiment variant, the amount of tenside may be in a quantity of 0.3 and 5% by weight, preferably between 0.5% by weight and 4% by weight, based on the mass of wool.

The reaction period of the steps c) and d) is preferably more than 10 s, preferably 30 s to 60 s.

In an embodiment variant there is provided that the step d) is carried out in an aqueous solution. The pH in this solution is preferably less than 12.

The reducing agent in step d) may, for example, contain sulphur. In this case, the salts of the sulphurous acid (sulphites) are preferred. For example, the amount of sulphite, based on the mass of wool, may be between 1% by weight and 35% by weight, preferably between 2% by weight and 20% by weight, especially preferably between 5 and 15% by weight.

There may also be provided post-treatment of the wool. This is realized after or concurrently with step e).

For the post-treatment, there may be provided a treatment using a substance that reduces surface friction, in particular softening agents and/or a polymer. The amount of softening agents or polymer preferably is such so that this results in a coating of more than 0.1% by weight of the product based on the mass of the wool.

In a preferred embodiment, polymers originating from the group of siloxanes are used.

In one aspect the invention relates to wool or wool products that are manufactured according to the method or that may be manufactured according to the method.

According to prior art, there have been proposed parts of the steps a) to e), but the novel combination has led to surprisingly good results, in particular in view of process stability and characteristics of the wool treated.

In the method according to the invention, there are combined continuous procedural techniques with semi-continuous operational techniques. In this way, it is possible to combine the relatively short treatment periods for a), c), d), which are between 10 s and 1 min, and e) with a semi-continuous treatment b), which may be more than 1.5 min.

In order to apply the solution of the oxidizing agent onto the wool, there is usually used a foulard, which is able to apply between 70% and 150% liquor in a defined way; in a preferred embodiment, the device is adjusted so that the constant coating quantities are transferred in the reaction section b) between 75% and 125% of the gross weight of the wool. In an especially preferred embodiment, the coating is between 90% and 110%. It is also possible to apply liquor by spraying, dropping or other known liquor application techniques.

The rate of the continuous device is a result of the well-known technical procedural factors of the construction, e.g., length of the dwell section in a treatment compartment, amounting to 5-12 m/min for conventional technical constructions, which corresponds to a treatment period per machine compartment of approximately 10 s to 30 s.

For step b), the exposing of the wool to the solution in order to complete the oxidization process, the wool impregnated with oxidization solution is applied onto a suitable tray so that there is possible a uniform temperature adjustment, not occurring any depositing of the treatment solution. For this purpose, conventional techniques of material trays may be used, such as, e.g., roll beds, screening belt conveyors, chutes, with a guided dwell section also being possible. In a preferred embodiment, the temperature in the tray is controlled. The temperature is kept below 60° C., in an especially preferred method, the temperature is kept below 45° C. The reaction period required for step b) is dependent on temperature and chemical substances or in step a), respectively, on the formulation used. A reaction period of more than 1.5 min has proven to be useful, and in a preferred embodiment of the method, the period of step b) is kept between 2 and 10 min Estimation of the reaction period may be realized by tests on the reaction rate of a formulation in step b) and analytical assessment of reaction progress.

In step c), the secondary reaction products from the treatment using the oxidizing agent are washed out using rinsing, thus being comprehensively removed. This step is preferably carried out by rinsing with water, with the treatment temperature being between 10° C. and 65° C.; in a preferred embodiment, the temperature of the washing water is 15-25° C. The treatment period is in the range of a conventional period typical for continuous treatment methods, which is between 10 s and 30 s. This step will improve method stability in an especially advantageous manner.

In step d), treatment of the rinsed wool is carried out using a reducing agent. This may originate from the group of sulphites, there may, however, also be tested other reducing substances by way of pre-tests in regard to the suitability thereof. The pH and the temperature of the treatment bath, thereby, are dependent on the dwell time available for section d). In a preferred embodiment, the dwell time is between 10 and 60 s, wherein the temperature is kept on a constant value in the range of 20-55° C., and the pH is kept constant in the range between 8 and 11 by dosing alkaline solutions or substances having a buffering effect, respectively, e.g., sodium carbonate or sodium bicarbonate, at a pH of less than 12.

In treatment step e), post-washing and post-treatment of the reductively treated wool is carried out. By way of intensive rinsing with water, the reaction chemicals and the products thereof will be removed from the wool. Subsequently, the application of suitable substances is realized, which as covers will reduce surface friction. For this purpose, a variety of substances may be used, wherein suitable chemicals may be selected from the class of polymeric substances and also of softening substances.

The selection of products and the amount of a polymeric/softening substance depends on the fineness of the wool fibre to be treated, which may be assessed using pre-tests. The temperature of the treatment solution may then be between 15° C. and 80° C., wherein in an especially preferred embodiment the solution is applied at room temperature.

Polymers may be selected from the following classes: polymers having primary, secondary and/or tertiary amino functions such as, e.g., homo- or copolymers of the acryl amide and/or methacryl amide with, for example, styrene, acrylic acid or acrylic acid esters; polyurethanes; polyalkylene imines; polyvinyl amines; polyamide amines; aliphatic, cyclo-aliphatic and aromatic polyisocyanates; polyethylenes; polyamide-epichlorine hydride resins; polyacrylates; polysiloxanes. In a preferred embodiment, there are used modified polysiloxanes, with amino-functional polysiloxanes being especially preferably suitable.

A softening agent may, for instance, originate from the group of the quaternary organic ammonium salts; from the group of well-known textile softening agents, also other suitable products may be determined rather easily by means of pre-testing.

If required, following washing steps, there may also be carried out intermediate drying steps.

As the treatment will lead to modifications in the wool structure, in particular in the cuticula, proof and identification of the treatment is possible via appropriate analytical methods. Apart from the modification of the molecular structure, which may be detected by way of infrared spectroscopy, microscopic methods such as, e.g., electron microscopic tests using EDX analysis (energy dispersive X-ray spectroscopy), AFM (atomic force microscopy) or optical microscopy are suitable to detect the various treatments. In particular microscopy using transmitted light of the fibres swollen in water and the microscopy of the fibres dyed using methylene blue are very suitable for distinguishing the treatment forms.

In the literature there have also been described modifications of the fibre accessibility as a result of the various treatments (Journal of the Textile Institute, 103/1, (2012) 55-63).

EXAMPLES OF USE

The percentages in the examples of use always relate to the amount of chemicals used, based on the amount of wool treated.

Example 1

A sliver having an average wool fineness of 20.5 μm is impregnated with a solution in the foulard. The bulk coating of potassium hydrogen peroxomonosulphate, hence, is approximately 7.6% of the wool mass at a liquor absorption of 100% of the good mass, and the bulk coating of the wetting agent is 1.5% of the wool mass. The solution is applied at 40° C., subsequently the product is then stored at least for 1.5 min at approx. 35° C.

Following a rinsing step using water, the treatment is carried out in a sulphite solution (150 g/l sodium sulphite). The consumption of sodium sulphite is then approximately 8% of the wool mass. The treatment is realized at 35° C. for 30 s, followed by rinsing with water.

The finalizing coating of 4% of the wool weight of a silicone-based polymer (40 g/l) is carried out by wet-in-wet coating, followed by a drying step. Shrinkage of the product in the washing tests is below 1%.

Example 2

A sliver having an average wool fineness of 21.5 μm is impregnated with a solution in the foulard. The bulk coating of potassium hydrogen peroxomonosulphate, hence, is approximately 5.4% of the wool mass at a liquor absorption of 100% of the good mass, and the bulk coating of the wetting agent is 1.5% of the wool mass. The solution is applied at 40° C., subsequently the product is then stored at least for 1.5 min at approx. 35° C. Following a rinsing step using water, the treatment is carried out in a sulphite solution (150 g/l sodium sulphite). The consumption of sodium sulphite is then approximately 8% of the wool mass. The treatment is realized at 35° C. for 30 s, followed by rinsing with water. The finalizing coating of 3% of the wool weight of a silicone-based polymer (30 g/l) is carried out by wet-in-wet coating, followed by a drying step. Shrinkage of the product in the washing tests is below 7.5%.

Example 3

A sliver having an average wool fineness of 26.5 μm is impregnated with a solution in the foulard. The bulk coating of potassium peroxomonosulphate, hence, is approximately 7% of the wool mass at a liquor absorption of 100% of the good mass, and the bulk coating of the wetting agent is 1.5% of the wool mass. The solution is applied at 40° C., subsequently the product is then stored at least for 1.5 min at approx. 35° C. Following a rinsing step using water, the treatment is carried out in a sulphite solution (150 g/l sodium sulphite). The consumption of sodium sulphite is then approximately 8% of the wool mass. The treatment is realized at 35° C. for 30 s, followed by rinsing with water. The finalizing coating of 2% of a silicone-based polymer is carried out by wet-in-wet coating, followed by a drying step. Shrinkage of the product in the washing tests is below 14.2%.

The invention claimed is:

1. A method for the chlorine-free anti-felting treatment of wool, comprising the steps of:

a) applying a solution onto the wool, wherein the solution has an oxidizing agent based on peroxomono sulphuric acid and a tenside, wherein the amount of the oxidizing agent based on peroxomono sulphuric acid is between about 5% to about 15% by weight based on the mass of wool, the amount of tenside is between 0.3% and 5% by weight based on the mass of wool, and the liquor uptake is between 70% and 150%;

b) exposing the wool to the solution for at least 1.5 minute in order to provide oxidation of the wool;

c) washing out secondary reaction products from the wool for at least 10 seconds;

d) treating the wool using sulphite as a reduction agent in an amount of 5% to 15% by weight based on the mass of wool for a dwell time within a range of 10 to 60 seconds, at a temperature within a range of 20 to 55° C., and while maintaining a pH within a range of 8 to less than 12; and e) post-washing, wherein the steps are carried out continuously.

2. A method according to claim 1, wherein the wool is provided as pure wool, a wool blend, loose fibres, sliver, yarn, fabric, crocheted fabrics, fleece, or a combination thereof.

3. A method according to claim 1, wherein the oxidizing agent comprises an inorganic monoperoxo compound.

4. A method according to claim 3, wherein the inorganic monoperoxo compound comprises peroxomono sulphuric acid ($H_2SO_5$), a salt thereof, or a combination thereof, wherein the tenside has a negative overall charge or a neutral charge of the surface active molecule part, and wherein the tenside is a non-ionic tenside.

5. A method according to claim 1, wherein the amount of tenside is between 0.5% by weight and 4% by weight based on the mass of the wool.

6. A method according to claim 1, wherein the solution applied in step a) has a pH of <7.

7. A method according to claim 1, wherein the temperature of the solution in step a) is up to 60° C.

8. A method according to claim 1, wherein step d) is carried out in an aqueous solution.

9. A method according to claim 1, further comprising post-treating the wool after or concurrently with step e).

10. A method according to claim 1, wherein the post-treating is carried out using a softening agent, a polymer or a combination thereof.

11. A method according to claim 1, wherein the dwell time in step c) is within a range of 30 to 60 seconds.

12. A wool product formed according to the method of claim 1.

13. A method for the chlorine-free anti-felting treatment of wool, comprising the steps of:

applying a solution onto the wool, wherein the solution has an oxidizing agent based on peroxomono sulphuric acid and a tenside, wherein the amount of the oxidizing agent based on peroxomono sulphuric acid is between about 5% to about 15% by weight based on the mass of wool, the amount of tenside is between 0.3% and 5% by weight based on the mass of wool, and the liquor uptake is between 70% and 150%;

exposing the wool to the solution for at least 1.5 minute to provide oxidation of the wool;

washing out secondary reaction products from the wool for a time between 10 and 60 seconds;

treating the wool in a treatment bath using sulphite as a reduction agent for a dwell time within a range of about 10 to 60 seconds, at a temperature within a range of about 20 to 55 degrees C., and while maintaining an alkaline via dosing of alkaline agents and/or buffering agents; and post-washing the wool, wherein the steps are carried out continuously.

14. A method according to claim 13, wherein treating the wool using a reduction agent includes a dwell time within a range of about 30 to 60 seconds.

15. A wool product formed according to the method of claim 13.

16. A method for the chlorine-free anti-felting treatment of wool, comprising the steps of:

applying a solution onto the wool having a pH of less than 7, wherein the solution has an oxidizing agent based on peroxomono sulphuric acid and a tenside, wherein the amount of the oxidizing agent based on peroxomono sulphuric acid is between about 5% to about 15% by weight based on the mass of wool, the amount of tenside is between 0.3% and 5% by weight based on the mass of wool, and the liquor uptake is between 70% and 150%;

exposing the wool to the solution for at least 1.5 minute to provide oxidation of the wool;

washing out secondary reaction products from the wool for a time between 10 and 60 seconds;

treating the wool in an aqueous treatment bath using sulphite as a reduction agent for a dwell time within a range of about 30 to 60 seconds, at a temperature within a range of about 20 to 55 degrees C., and while maintaining an alkaline pH within the treatment bath within a range of about 8 to about 12 via dosing of alkaline agents and/or buffering agents;

post-washing the wool; and post-treating the wool with using a softening agent, a polymer or a combination thereof.

* * * * *